US007165363B2

(12) United States Patent
Headrick, II et al.

(10) Patent No.: US 7,165,363 B2
(45) Date of Patent: Jan. 23, 2007

(54) MANUALLY SEPARABLE RIDGE VENT

(75) Inventors: John C. Headrick, II, Atlanta, GA (US); J. Charles Headrick, Alpharetta, GA (US)

(73) Assignee: Building Materials Investment Corp., Wayne, NJ (US)

( * ) Notice: Subject to any disclaimer, the term of this patent is extended or adjusted under 35 U.S.C. 154(b) by 0 days.

(21) Appl. No.: 10/421,193

(22) Filed: Apr. 23, 2003

(65) Prior Publication Data

US 2004/0088928 A1 May 13, 2004

Related U.S. Application Data

(63) Continuation-in-part of application No. 10/293,376, filed on Nov. 12, 2002, now Pat. No. 7,024,828.

(51) Int. Cl.
*E04B 7/00* (2006.01)

(52) U.S. Cl. ..... 52/198; 52/98; 52/57; 454/365

(58) Field of Classification Search ..... 52/57, 52/198, 199, 41–44, 302.3, 302.6, 95, 98–99; 454/364–367
See application file for complete search history.

(56) References Cited

U.S. PATENT DOCUMENTS

| | | | | |
|---|---|---|---|---|
| 2,277,758 A | * | 3/1942 | Hawkins | 52/98 |
| 3,185,070 A | | 5/1965 | Smith | 98/42 |
| 3,236,170 A | | 2/1966 | Meyer et al. | 98/42 |
| 3,660,955 A | | 5/1972 | Simon | 52/420 |
| 3,797,180 A | * | 3/1974 | Grange | 52/95 |
| 3,949,657 A | | 4/1976 | Sells | 98/42 A |
| 4,280,399 A | | 7/1981 | Cunning | 98/42 A |
| 4,676,147 A | | 6/1987 | Mankowski | 98/42.21 |
| 4,709,519 A | * | 12/1987 | Liefer et al. | 52/98 |
| 4,817,506 A | | 4/1989 | Cashman | 98/42.21 |
| 4,843,953 A | | 7/1989 | Sells | 98/42.21 |
| 4,899,505 A | | 2/1990 | Williamson et al. | 52/199 |
| 4,903,445 A | | 2/1990 | Mankowski | 52/199 |
| 4,924,761 A | | 5/1990 | MacLeod et al. | 98/42.21 |
| 4,957,037 A | | 9/1990 | Tubbesing et al. | 98/42.21 |
| 5,009,149 A | | 4/1991 | MacLeod et al. | 98/42.21 |
| 5,052,286 A | | 10/1991 | Tubbesing et al. | 98/42.21 |
| 5,054,254 A | | 10/1991 | Sells | 52/199 |
| 5,060,431 A | | 10/1991 | MacLeod et al. | 52/199 |
| 5,070,771 A | | 12/1991 | Mankowski | 454/275 |
| 5,092,225 A | | 3/1992 | Sells | 454/365 |
| 5,095,810 A | | 3/1992 | Robinson | 454/365 |
| 5,112,278 A | | 5/1992 | Roberts | 98/365 |
| 5,122,095 A | | 6/1992 | Wolfert | 454/365 |
| 5,149,301 A | | 9/1992 | Gates | 454/365 |

(Continued)

*Primary Examiner*—Jeanette E. Chapman
(74) *Attorney, Agent, or Firm*—Womble Carlyle Sandridge & Rice

(57) ABSTRACT

A ridge vent has an elongated body having a width sufficient to span the ridge of a roof along which the ridge vent is installed. Tear lines of relative weakness are formed at spaced intervals along the elongated body. The tear lines may be formed by score lines, perforations, or otherwise and are configured to allow the body of the ridge vent to be separated manually at a selected tear line by grasping the body and tearing along the tear line.

Depending partitions may be disposed on the underside of the body on either side of each tear line to form end walls at new ends formed when the ridge vent is separated along a tear line.

15 Claims, 9 Drawing Sheets

U.S. PATENT DOCUMENTS 5,167,579 A 12/1992 Rotter ..... 454/365
5,304,095 A 4/1994 Morris ..... 454/365
5,425,672 A 6/1995 Rotter ..... 454/365
5,457,920 A * 10/1995 Waltz ..... 52/199
5,458,538 A * 10/1995 MacLeod et al. ..... 454/365
5,535,558 A * 7/1996 Rieke et al. ..... 52/199
5,600,928 A 2/1997 Hess et al. ..... 52/309.4
5,765,318 A * 6/1998 Michelsen ..... 52/98
5,817,387 A * 10/1998 Allwein et al. ..... 428/43
6,141,930 A * 11/2000 Allwein et al. ..... 52/404.1
6,149,517 A * 11/2000 Hansen ..... 454/365
6,227,963 B1 * 5/2001 Headrick ..... 454/365
6,233,887 B1 * 5/2001 Smith ..... 52/199
6,260,315 B1 * 7/2001 Smith ..... 52/199
6,277,024 B1 * 8/2001 Coulton ..... 454/365
6,684,581 B1 * 2/2004 Robinson et al. ..... 52/198

* cited by examiner

MANUALLY SEPARABLE RIDGE VENT

REFERENCE TO RELATED APPLICATION

This is a continuation-in-part of U.S. patent application Ser. No. 10/293,376 filed Nov. 12, 2002 now U.S. Pat No. 7,024,828. My prior U.S. Pat. Nos. 6,227,963 and 6,371,847 are hereby incorporated by reference as if fully set forth herein.

TECHNICAL FIELD

This invention relates generally to attic ventilation and more specifically to "shingle-over" ridge vents installable along an open ridge of a roof to provide ventilation.

BACKGROUND

It is important when constructing modern homes and other buildings that the attic space of the building be adequately ventilated. The failure to provide adequate ventilation can result in a variety of serious problems including, for example, the accumulation of moisture in and around the attic space and problems associated therewith. A variety of attic ventilation techniques and products have been used over the years to provide attic ventilation. These include open-eve vents, attic fans, and convection vents spaced along a roof near its ridge. More recently, so called "shingle-over ridge vents" have become increasingly ubiquitous in homes and commercial buildings. A shingle-over ridge vent is a long usually plastic panel that generally is installed along the ridge of a roof covering an open slot formed therealong. The ridge vent is formed with air passageways and openings that allow hot air within the attic to escape through the ridge slot while the ridge vent covers the open slot preventing rain and debris from entering the attic. Once installed, the ridge vent is covered over with shingles to provide an aesthetically pleasing substantially normal appearance along the roof ridge.

Ridge vents generally are available in two fundamental configurations; namely, relatively short panel-type ridge vents, which are individually positioned and installed end-to-end along a roof ridge, and so-called "rolled" ridge vents, which are long continuous vents that are provided in rolls and are un-rolled along a roof ridge and attached with nails or staples. Each has its advantages and shortcomings. For instance, panel ridge vents can be designed with more elaborate features such as wind baffles outboard of the vent openings that improve air flow by generating low pressure regions just inboard of the wind baffles in the regions of the vent openings. For this and other reasons, panel-type ridge vents in general are highly efficient at providing attic ventilation. However, they are difficult and time consuming to install because each panel must be installed separately in end-to-end relationship with adjacent panels.

Rolled ridge vents, on the other hand, are simple to install relative to panel-type ridge vents because a roofer need only roll the vent out along the ridge, cut it to length, and attach it to the roof. However, since rolled ridge vents must be flexible in order to be rolled, they typically are much less sophisticated in design and configuration than panel-type ridge vents. Sometimes rolled ridge vents are nothing more that long bats of loosely woven fibrous plastic material that presumably allow air flow to flow through their open weave structure. Traditionally, rolled ridge vents have not included the complex air channels, vents, and wind baffles of panel-type ridge vents. As a result, rolled ridge vents, although easy to install, have been shown to be exceedingly inefficient at providing attic ventilation and some are not much better than having no vent at all.

At least one attempt has been made to develop a ridge ventilation system that is rollable into compact rolls for convenient storage and installation yet that includes some of the sophisticated design features and provides the efficient air flow characteristics of panel-type ridge vents. U.S. Pat. No. 6,260,315 discloses such a rollable ridge vent. In this design, a plastic central panel is formed with wind baffles outboard of the panel's edges. The wind baffles are corrugated or, according to the patent, "undulating," to allow the panel to be rolled-up into a compact roll similar to open weave mat-type rolled ridge vents. When rolled, the corrugated wind baffles flex in an accordion-like manner to allow for the rolling of the vent. The panel also is formed with a somewhat elaborate array of supports on its underside to maintain spacing between the roof decking and the panel such that air flow allegedly is not restricted. While the design of this ridge vent may be a step in the right direction, it nevertheless has its own set of problems and shortcomings. For example, the corrugated or "undulating" configuration of the wind baffles increases substantially the amount of plastic required to mold the panel and thus increases the cost of the product. This is also true for the elaborate support structures on the underside of the panel. More importantly, the support structures and vent design of this product decreases its net-free-area (NFA) and therefore decreases its ventilation efficiency. It also is believed that the corrugated or undulating shape of the side baffles disrupts the laminar flow of wind across the vent, thereby destroying or degrading the formation of a low pressure region (sometimes referred to as the "venturi effect") just inboard of the wind baffles, which accounts for much of the increased efficiency of panel-type ridge vents. Accordingly, although the product disclosed in the '315 patent purportedly is rollable, it still fails to provide the corresponding high efficiency ventilation of well designed panel-type ridge vent systems.

Another problem with rollable ridge vents, and, indeed, panel-type ridge vents as well, relates to the need to cut the vents near the end of a ridge along which they are being installed. Specifically, when the end of the ridge is reached during installation, the ridge vent must be cut to length so that the end of the vent is spaced properly from the end of the roof ridge. For rolled ridge vents, this means that the installed length of vent must be cut from the remaining roll. For panel-type ridge vents, the last panel, which can be four or five feet long, often is too long and must be cut, again so that the end of the vent is properly spaced from the end of the roof ridge. In either case, the vent must be carefully measured, marked, and cut with a knife or other sharp tool. This process is time consuming, can be frustrating for the installer, and is subject to human error in measurement and cutting.

Cutting the end of a ridge vent also can result in a gap between the roof deck and the vent panel at the end of a length of ridge vent. Such a gap is unacceptable because it provides an entry point for blowing rain, insects, and vermin to enter the attic. Accordingly, special end plugs are sometimes provided and must be installed in the cut end of the ridge vent to plug the gap. This is even more time consuming and frustrating and can even be skipped by an installer, causing leakage and infestation problems. Another problem when cutting some types of ridge vent is the resulting production of scrap pieces of vent. This is particularly true with molded plastic ridge vents because a length of the cut-off portion of the vent must be removed up to the next end wall and discarded.

Accordingly, a need persists for a ridge vent that provides the ease of installation of a traditional rolled ridge vent product and also the highly efficient air-flow and ventilation characteristics of a panel-type ridge vent system. Such a ridge vent should have a high net free area for unhampered flow of air from the attic space, should require a minimum volume of plastic for its fabrication, and should verifiably exhibit ventilation characteristics comparable to those of panel-type ridge vents. A further need exists for a ridge vent incorporating features that eliminate the need to measure and cut the vent at the end of a roof ridge. These features should allow the vent to be separated manually, quickly, and easily without cutting and, once separated, should provide its own end plug or end wall to prevent leakage and infestation at the end. All of this should be accomplished without creating scrap. It is to the provision of a ridge ventilation system that addresses these and other needs that the present invention is primarily directed.

SUMMARY OF THE INVENTION

Briefly described, the present invention, in one preferred embodiment thereof, comprises a rollable baffled ridge vent system that provides both convenience of installation and highly efficient ventilation. The ridge vent system includes an elongated plastic ridge vent that is supplied in rolls and that is unrolled and attached along the ridge of a roof in a manner similar to traditional open weave mat-type ridge vents. However, the vent of this invention has a configuration similar to panel-type ridge vents. More specifically, the vent, which preferably is formed of injection molded plastic, has a top panel with a flexible central portion and edges. A substantially flat upstanding wind baffle is positioned along and outboard of the edges of the panel. A series of narrow louvers or ribs extend from the edge of the panel downwardly to the bottom portion of the wind baffle. The spaces between the louvers together form an opening though which attic air can escape laterally from beneath the panel.

In order to provide for rollability of the vent, the substantially flat upstanding outboard wind baffle is defined by a series of relatively short baffle sections that each is supported by a pair of buttresses extending laterally from beneath the panel. The buttresses project a significant distance inwardly toward the center portion of the panel such that, in addition to supporting the baffle sections, they also form a series of laterally extending supports on the underside of the panel. These supports rest on the roof and maintain spacing between the roof shingles and the underside of the panel to provide a plenum through which air flows laterally out the side vents. Since the supports are relatively thin and extend in a lateral direction relative to the panel, they do not significantly reduce the NFA of the vent and thus do not degrade the air flow through the vent.

The sectioned substantially flat baffle sections are aligned and co-extensive and together form a substantially continuous outboard substantially flat wind baffle similar to those of panel-type ridge vents. This configuration preserves the laminar flow of wind across the vent and the resulting low pressure in the region of the louvered opening, which enhances air flow. However, when the vent is rolled up along its length, the adjacent baffle sections splay with respect to each other. This allows long sections of vent to be delivered in rolls and rolled out along a roof ridge for installation similar to traditional open weave mat-type vents. The spacing between the ribs of the louvered vent, the space between the edges of the panel and the baffle, and the thickness of the laterally extending supports are selected to provide the maximum possible NFA. All of these features provide ventilating performance similar to that of traditional panel-type ridge vents. Further, the flat design of the baffles and the simple lateral supports/baffle buttresses require a minimum of plastic material during fabrication.

In another preferred embodiment, a length of ridge vent, which may be a rollable or panel-type ridge vent, is provided at spaced intervals along its length with transversely extending tear lines. The tear lines, which are lines of relative weakness, are designed to allow the ridge vent to be selectively separated through a manual tearing action by an installer. In one configuration, the tear lines are defined by score lines of decreased thickness molded into and extending across the vent. In another, the tear lines are defined by perforations extending laterally across the ridge vent. On the underside of the vent panel, a pair of closely spaced depending lateral partitions are located on either side of each tear line. In this way, when a ridge vent is separated along a selected tear line, an end wall or end plug is automatically disposed at each of the resulting ends where the vent was separated.

In use, an installer installs ridge vent of this embodiment along the ridge of a roof in the usual way. When the end of the roof ridge is reached, a tear line that is near where the vent should terminate is selected and the vent is separated simply be being manually torn along the tear line. The resulting end is then attached to the roof with nails or staples with one of the depending partitions automatically forming an end wall or end plug that prevents leakage and infestation through the end of the ridge vent. Ridge shingles are then installed on top of the vent in the traditional way and installation is completed.

Accordingly, a rollable baffled ridge vent is now provided that addresses successfully the problems and shortcomings of the prior art. Long sections of the vent may be rolled-up into convenient rolls and installed quickly and easily just like mat-type ridge vents. Nevertheless, the vent of this invention provides superior ventilation similar to traditional panel-type ridge vents. It exhibits maximum NFA for superior air flow and requires a minimum of plastic for its construction. The ridge vent also incorporates features allowing it to be manually torn or separated at the end of a roof ridge, thus eliminating the need for measuring, cutting, and plugging the ridge vent at its end. These and other features, objects, and advantages of the present invention will become more apparent upon review of the detailed description set forth below when taken in conjunction with the accompanying drawing figures, which are briefly described as follows.

DETAILED DESCRIPTION OF THE PREFERRED EMBODIMENTS

Figure 1:
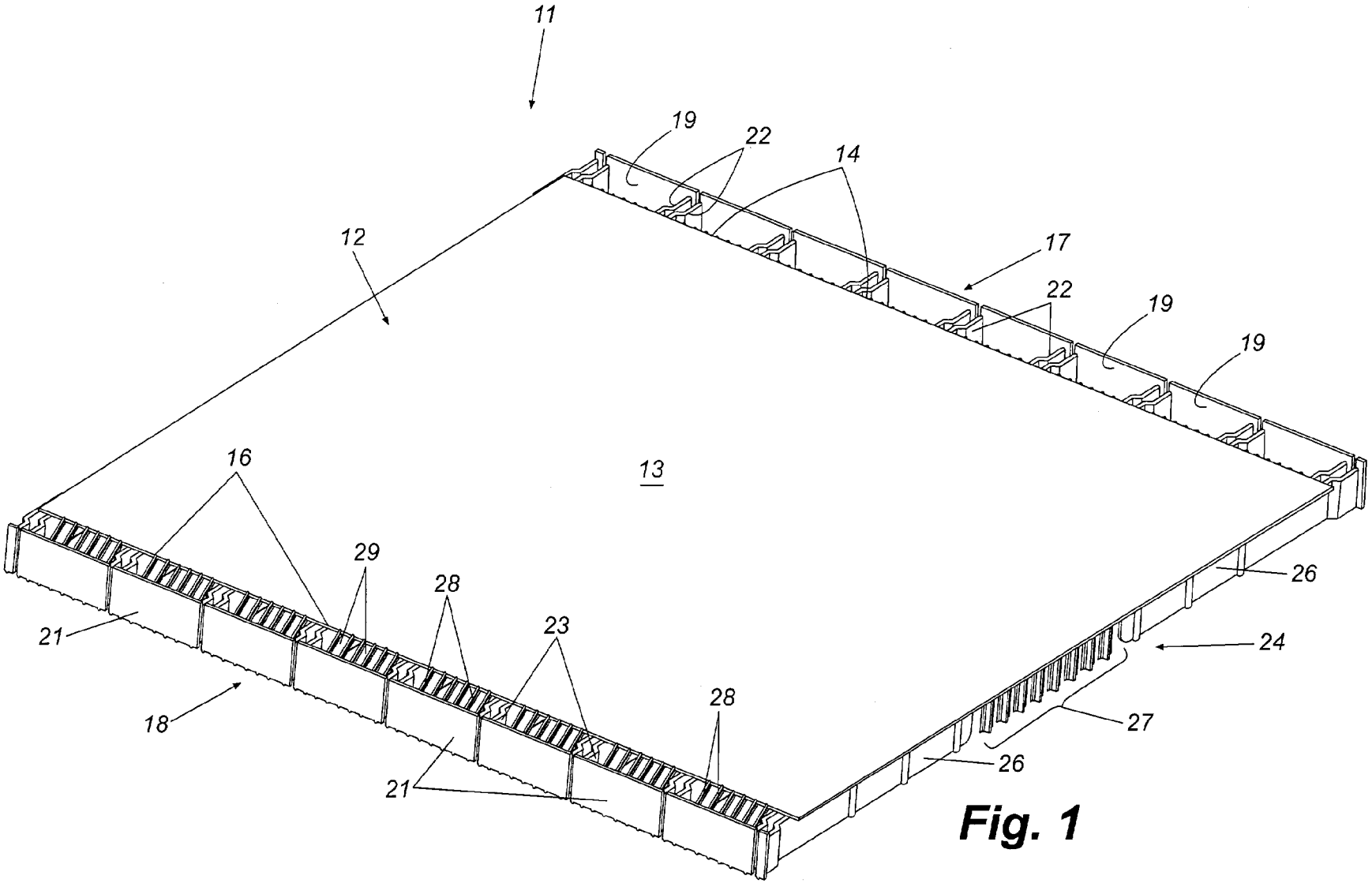
FIG. 1 is a perspective view of a short section of a rollable baffled ridge vent that embodies principles of the present invention in a preferred form.

Referring now in more detail to the drawings, in which like reference numerals refer to like parts throughout the several views, FIG. 1 illustrates a relatively short section of a rollable baffled ridge vent that embodies principles of the present invention in a preferred form. It will be understood that a complete ridge vent is much longer than the short section illustrated in FIG. 1 for unrolling from a rolled-up configuration along the ridge of a roof. A short section is illustrated in the drawings for simplicity and clarity of description. The ridge vent 11, which is made of molded plastic, is formed with a top panel 12 having a laterally flexible central portion 13 and edges 14 and 16. Wind baffles 17 and 18 extend along and outboard of respective edges 14 and 16. Wind baffle 17 is defined by a plurality of aligned coextensive substantially rectangular baffle sections 19 that together form a wind baffle that presents a generally flat or smooth face to a lateral wind blowing across the ridge vent 11. Similarly, wind baffle 18 is defined by a plurality of aligned coextensive rectangular baffle sections 21 that also form a baffle presenting a generally flat face to a lateral wind. The term "flat" as used herein with respect to the wind baffles and the aligned sections that define them means that the surfaces of the wind baffles are substantially smooth in the longitudinal direction to promote laminar wind flow and maximize the venturi effect mentioned above. The may be somewhat curved in the lateral direction is desired and the term "flat" is not meant to exclude such wind baffle configurations.

Each of the baffle sections 19 is supported and held in position outboard of edge 14 by a pair of buttresses 22 extending laterally outwardly from beneath the top panel 12, as described in more detail below. Each of the baffle sections 21 along the other edge 16 of the top panel likewise is supported and held in position outboard of edge 16 by a pair of buttresses 23 extending laterally from beneath the top panel. The outboard positioning of the baffles 17 and 18 defines a longitudinal space or opening between the panel edges and their respective wind baffles through which attic air can escape from beneath the top panel. An array of spaced apart ribs 28 extend from the edge 16 of the top panel 12 to the bottom edge of each baffle section 21. The ribs 28 span the opening between the edge 16 of the panel and the baffle 21 to prevent insects and other debris from entering through the opening while at the same time allowing for the relatively free flow of attic air out through the opening. Identical arrays of ribs span the opening along the other edge 14 of the panel for the same purpose.

Figure 5:
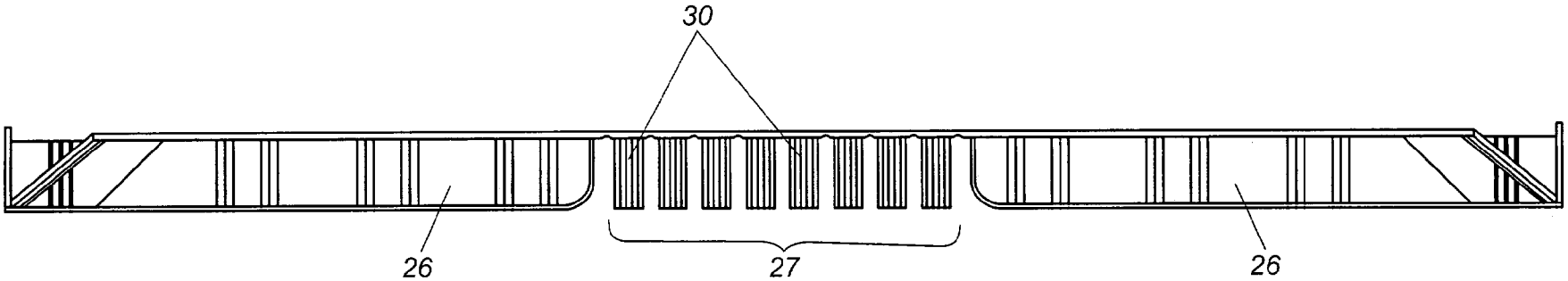
FIG. 5 is a longitudinal cross section of the vent panel section of FIG. 1 in which the integral self-sealing end wall of the vent is visible.

An end wall 24 depends from the top panel 12 on at least one end thereof. This is the free or exposed end of the ridge vent that is located near the end of a roof ridge when the ridge vent is installed. The end wall 24 spans the gap between the top panel 12 and the roof shingles to prevent water, insects, and debris from entering through the exposed end of the ridge vent. The end wall is formed by a pair of solid side sections 26 that depend downwardly to rest on the roof shingles and a fanned central section 27 in the region between the side sections. The central section 27 is formed by an array of side-by-side slightly tapered fingers or segments 30 (FIG. 5). When the ridge vent 11 is flexed laterally along its central portion 13 during installation along a roof ridge, the fingers 30 bunch together to form, along with the side sections 26, a substantially impervious end wall across the width of the vent 11.

It will be recognized by those of skill in the art that the just described ridge vent resembles in many respects a traditional panel-type ridge vent that is installed on a roof in separate end-to-end sections. As a result, the ridge vent of the present invention has been shown to provide the same or similar superior attic ventilation as panel-type ridge vents. However, as a result of the unique construction of the present ridge vent, and particularly the sectioned design of the wind baffles 17 and 18, the vent can be manufactured as long roof-length sections that are rolled up into efficient rolls for storage and transport. During installation, the sections simply are unrolled along the ridge of a roof and attached to the roof decking with nails, staples, or other appropriate fasteners. Thus, the ridge vent of this invention offers both the superior ventilation of panel-type ridge vents and the convenience and efficient installation of open weave mat-type rolled ridge vents.

Figure 2:
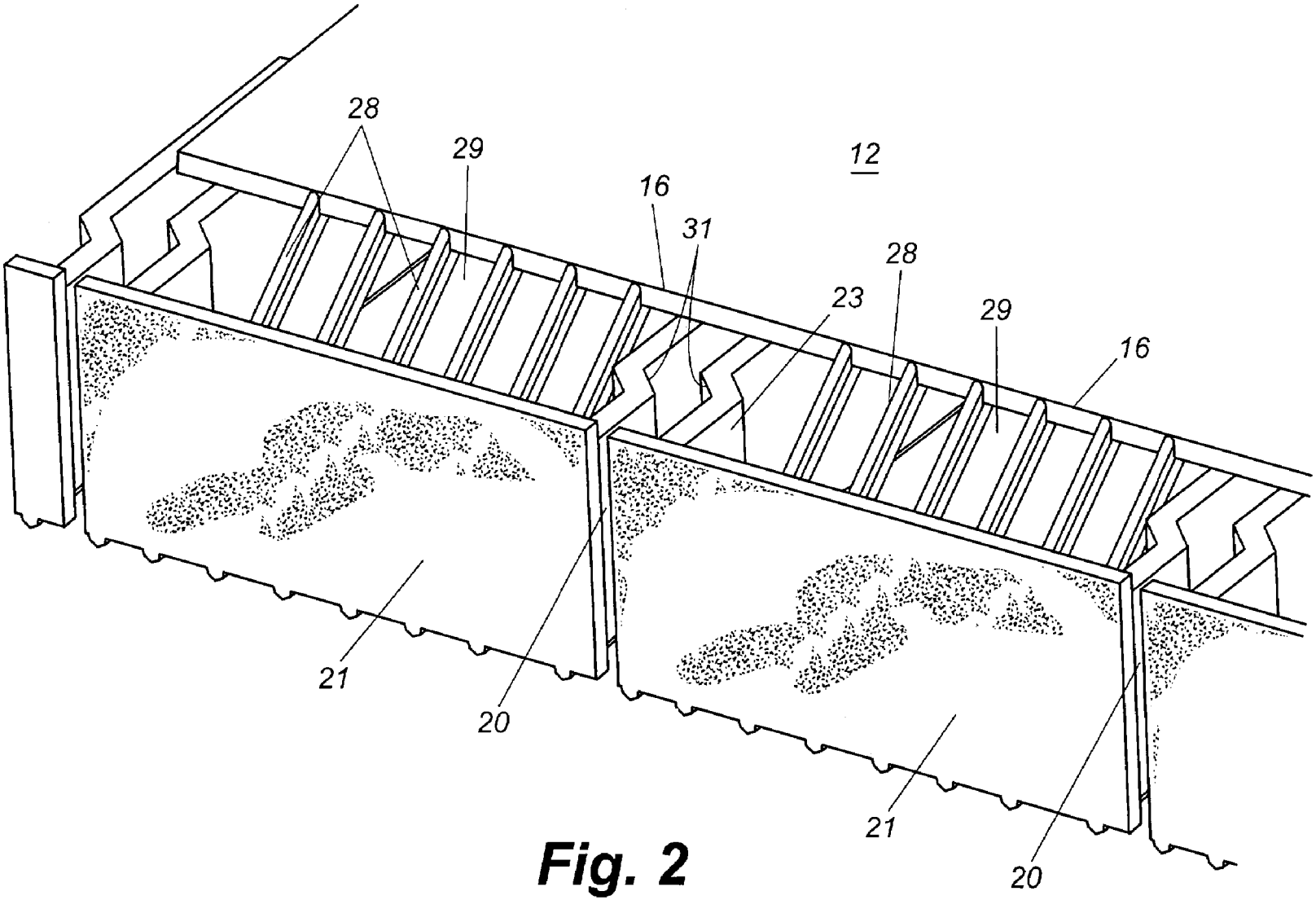
FIG. 2 is an enlarged perspective view of a portion of the vent of FIG. 1 illustrating the baffle sections, their supporting buttresses, and the louvered opening.

FIG. 2 is an enlarged view of a portion of the ridge vent 11 illustrating more clearly the design of the baffle sections 21. Each baffle section 21 in the illustrated embodiment has a substantially flat generally rectangular shape and is supported and positioned outboard of the panel edge 16 by a pair of buttresses 23 that extend from beneath the top panel 12 adjacent the ends of the baffle section. The baffle sections 21 are mutually aligned and co-extensive with each other and together define the wind baffle that extends along the length of the vent. Adjacent baffle sections are separated by a narrow gap 20 that opens into the space between buttresses 23 of the sections and ultimately into the space beneath the top panel 12 of the vent. The gaps 20 are sufficiently small to prevent insects and other debris from entering. However, in order to prevent blowing rain from entering through the gaps 20 and leaking into the attic space, the buttresses 23 are formed with matching offsets 31. These offsets form an efficient barrier to windblown rain that might enter the gaps 20 and prevent the rainwater from migrating beneath the top panel 12 and into an attic. A series of small tabs 35 are positioned along the bottom of each baffle section 21. The tabs 35 rest on the shingles of a roof on either side of the ridge and provide a narrow gap beneath the baffle sections through which water entering through the vents or the opening between the wind baffle and the top panel can escape. FIG. 2 also provides a better view of the ribs 28 separated by spaces 29 through which attic air escapes from beneath the top panel 12. The ribs 28 preferably are as narrow as possible in their transverse directions and each is formed with a generally aerodynamic shape to present minimum resistance to air flow and to maximize the net free area of the ridge vent 11.

Figure 3:
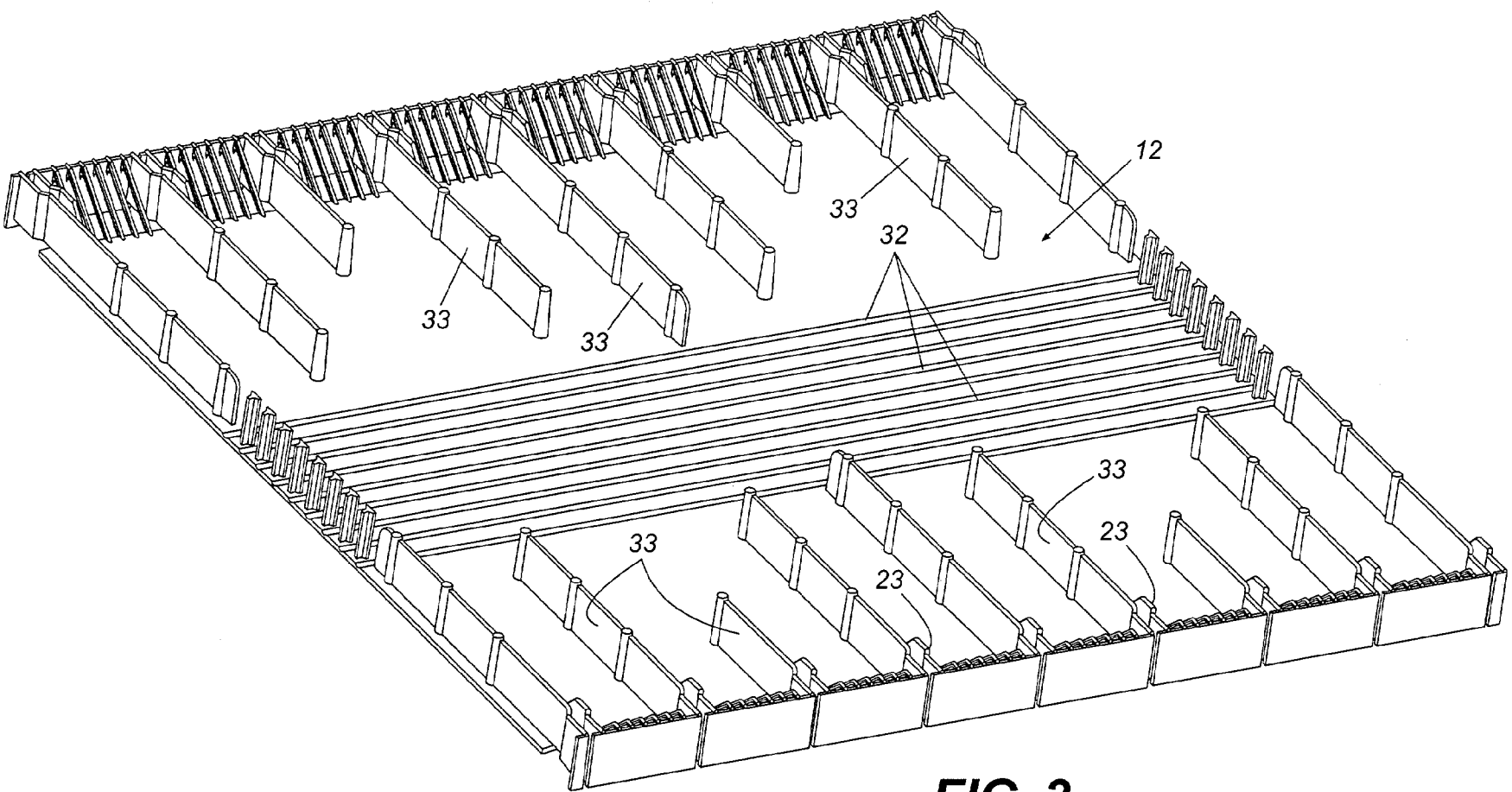
FIG. 3 is a perspective view from the underside of the vent section of FIG. 1 illustrating the inward extension of the buttresses to form lateral support structures beneath the panel.
Figure 4:
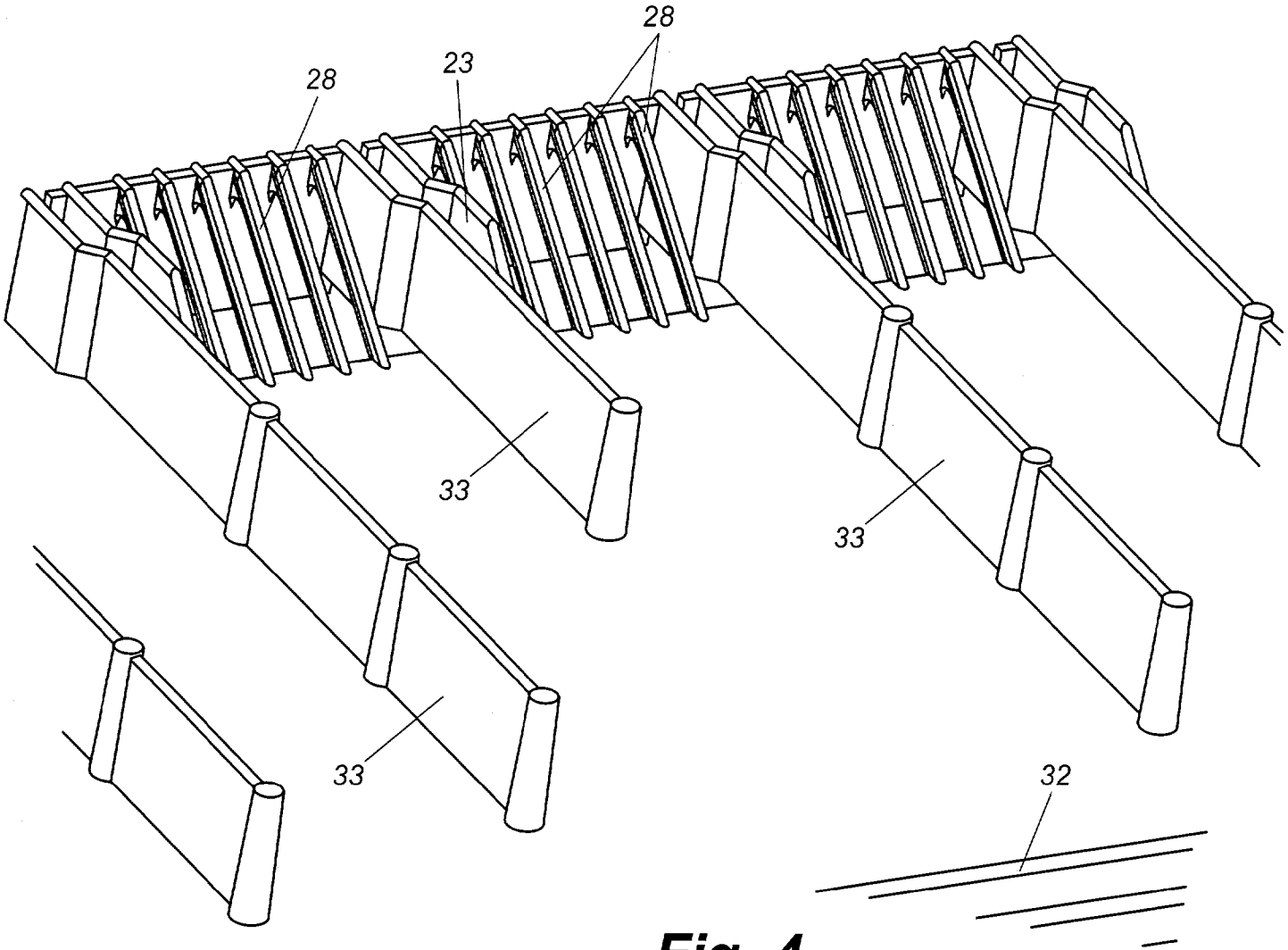
FIG. 4 is an enlarged perspective view of a portion of the underside of the vent shown in FIG. 3 illustrating more clearly the design of the dual function buttress supports.

FIG. 3 is a perspective view of the underside of the ridge vent of the present invention. An array of longitudinally extending scores 32 are formed along the central portion of the panel 12 to enhance the lateral flexibility of the panel in the region where it will be bent over the ridge of a roof. The buttresses that support the outboard baffle sections of the ridge vent extend laterally inwardly toward the central portion of the panel to form a plurality of supports 33. The supports 33 rest on the shingles of a roof on either side of the roof ridge to support the top panel 12 and to maintain the proper spacing between the panel and the roof shingles below. Significantly, and unlike many prior art ridge vents, the supports 33 are relatively thin and extend only laterally relative to the ridge vent. In this way, the supports 33 present the minimum possible obstruction to attic air moving outwardly toward the edges of the vent. As a result, the net free area of the ridge vent is maximized while also providing adequate support for the top panel for receiving nails and shingles. In the embodiment illustrated in FIGS. 1–6, the supports 33 preferably vary in length as shown in FIG. 3 and only every other buttress extends inwardly a significant distance from the respective edge of the panel 12. In this way, the volume of plastic required in the fabrication of the ridge vent is minimized while providing adequate support beneath the panel. FIG. 4 is an enlarged view of a portion of the underside of the ridge vent illustrating in more detail the configuration of the buttresses 23 and supports 33 on the underside of the panel 12.

FIG. 5 is a cross-sectional view of a ridge vent of the present invention looking toward a depending end wall thereof. As previously described, the end wall is formed by a pair of solid depending side sections 26 and a fanned central section 27 defined by a plurality of slightly tapered fingers 30. When the panel of the ridge vent is bent across the ridge of a roof during installation, the fingers 30 bunch together and may even overlap one another to form a substantially impervious end wall at the exposed free ends of a ridge vent installation. As best seen in FIG. 4, the side sections 26 of the end wall, like the supports 33, are inward lateral extensions of buttresses that support baffle sections of the ridge vent.

Figure 6:
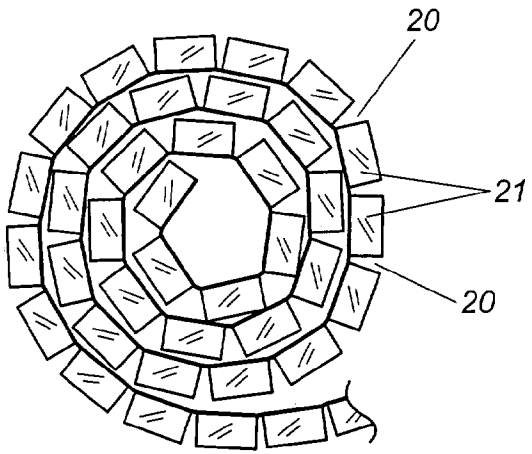
FIG. 6 illustrates a long section of the ridge vent of this invention rolled into a compact roll for shipping and for unrolling onto a roof ridge for installation.

As discussed above, one novel feature of the present invention is its ability to be fabricated in long roof-length sections that are rollable into convenient rolls. FIG. 6 is an end view of such a roll illustrating how the uniquely designed and supported baffle sections of the vent allow for the rollability of the ridge vent. Specifically, when a length of ridge vent is rolled with the top panel facing the center of the roll, the baffle section 21 simply skew or splay with respect to each other with the gaps 20 between adjacent baffle sections spreading into triangular shapes as illustrated. In this way, a single ridge vent having a length sufficient to extend from one end of a roof ridge to the other can be rolled into a compact roll for shipment to a building site. For installation, the ridge vent is simple unrolled along the roof ridge, positioned, and attached to the roof decking with staples, nails, or other appropriate fasteners.

The ridge vent of the present invention may be manufactured using any appropriate fabrication technique, including, possibly, extrusion techniques, roll molding techniques, or otherwise. In the preferred embodiment, however, it has been found most efficient, because of the somewhat complex profile of the vent, to injection mold the vent in relatively short sections of, say, four or five feet in length. These sections are then attached together during the fabrication process in end-to-end relationship to form a rollable ridge vent of any desired length. The sections may be attached together by any appropriate technique such as, for example, with adhesives, locking tabs formed on the ends of the sections, or, preferably, by sonically welding the sections together at their ends. If roll molding or extrusion techniques are used instead, they may allow for the fabrication of the ridge vent in arbitrarily long unitary sections.

The rolled ridge vent of the present invention, when installed along the open ridge of a roof, provides superior ventilation comparable to prior art panel-type ridge ventilation systems. This is due, in part, to the maximized net free area of the vent as discussed above. In addition, the outboard wind baffles of the present vent are smooth and substantially flat in the longitudinal direction rather than corrugated, undulating, or otherwise discontinuous. As a result, the baffles do not tend to disrupt the substantially laminar flow of wind up and over the wind baffles and across the ridge vent as can be the case with discontinuous baffles. It is believed that maintaining a laminar flow, in contrast to the turbulent flow that can be caused by discontinuous non-flat baffles, results in a more consistent and a stronger low pressure region immediately inboard of the baffles. This, in turn, draws more attic air through the roof ridge resulting in better ventilation performance.

Figure 7:
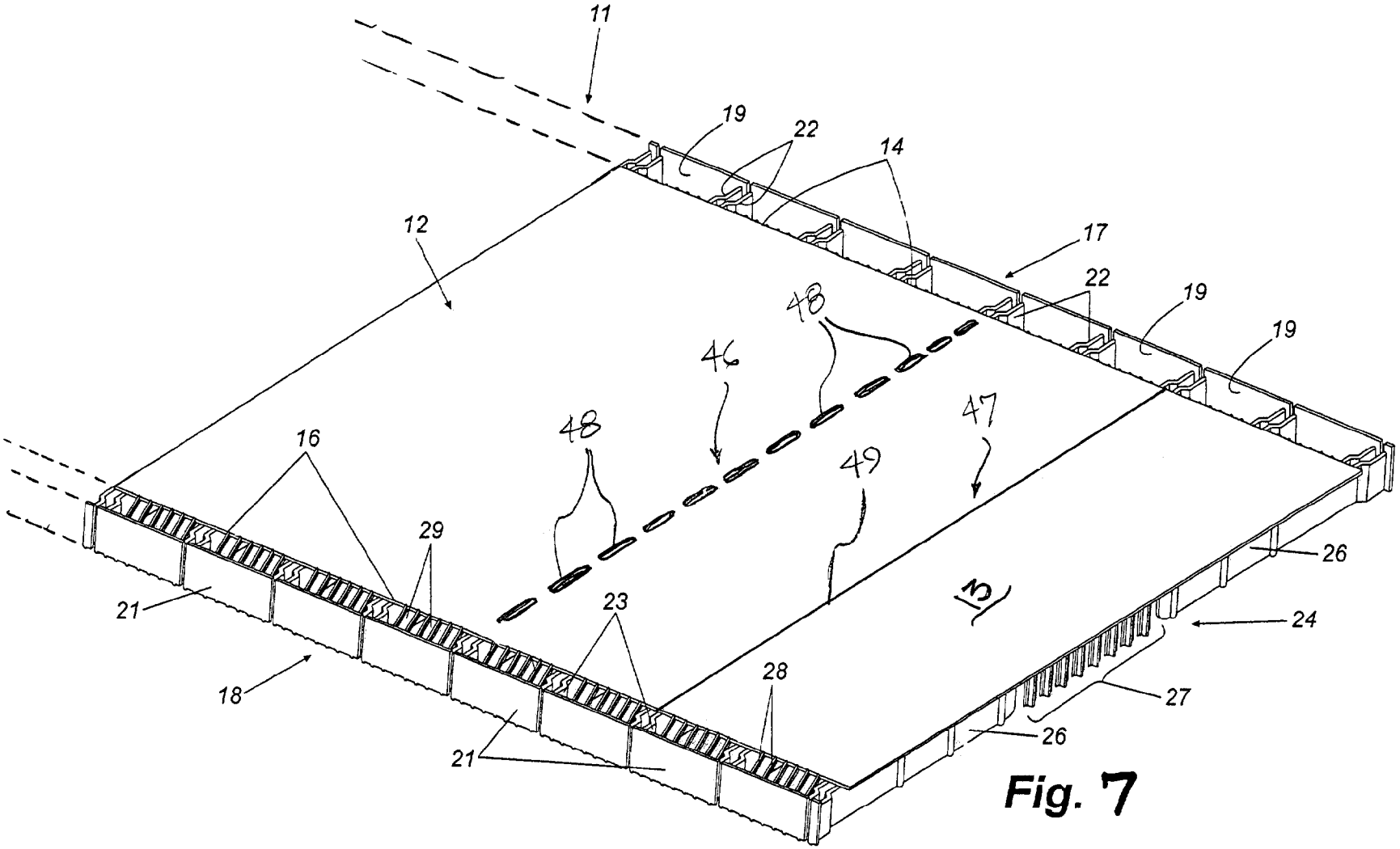
FIG. 7 is a perspective view of a section of a ridge vent that incorporates lateral tear lines according to principles of the invention.
Figure 8:
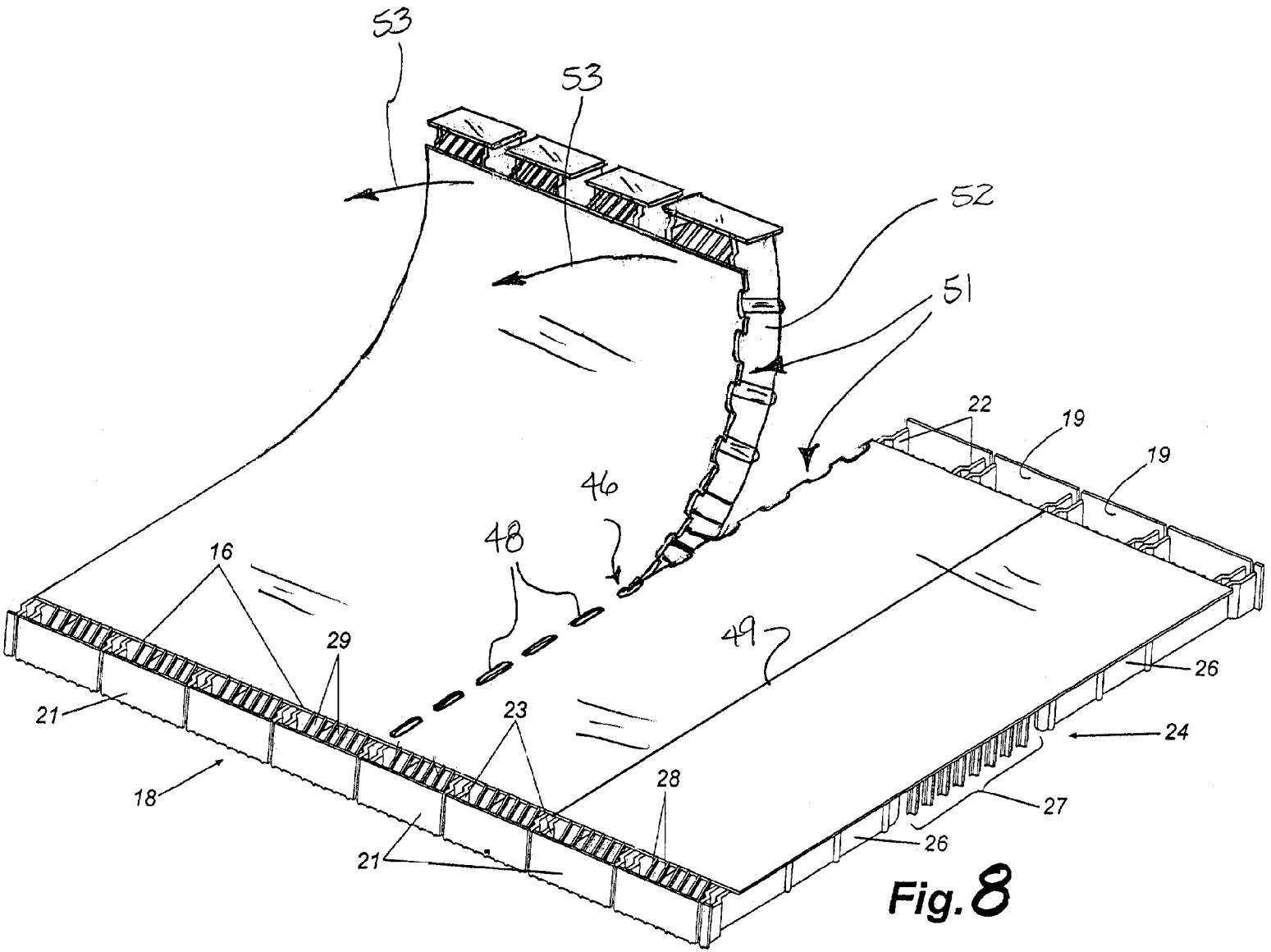
FIG. 8 is a perspective view of the ridge vent section of FIG. 7 showing the vent being separated by tearing action along the tear line.
Figure 9:
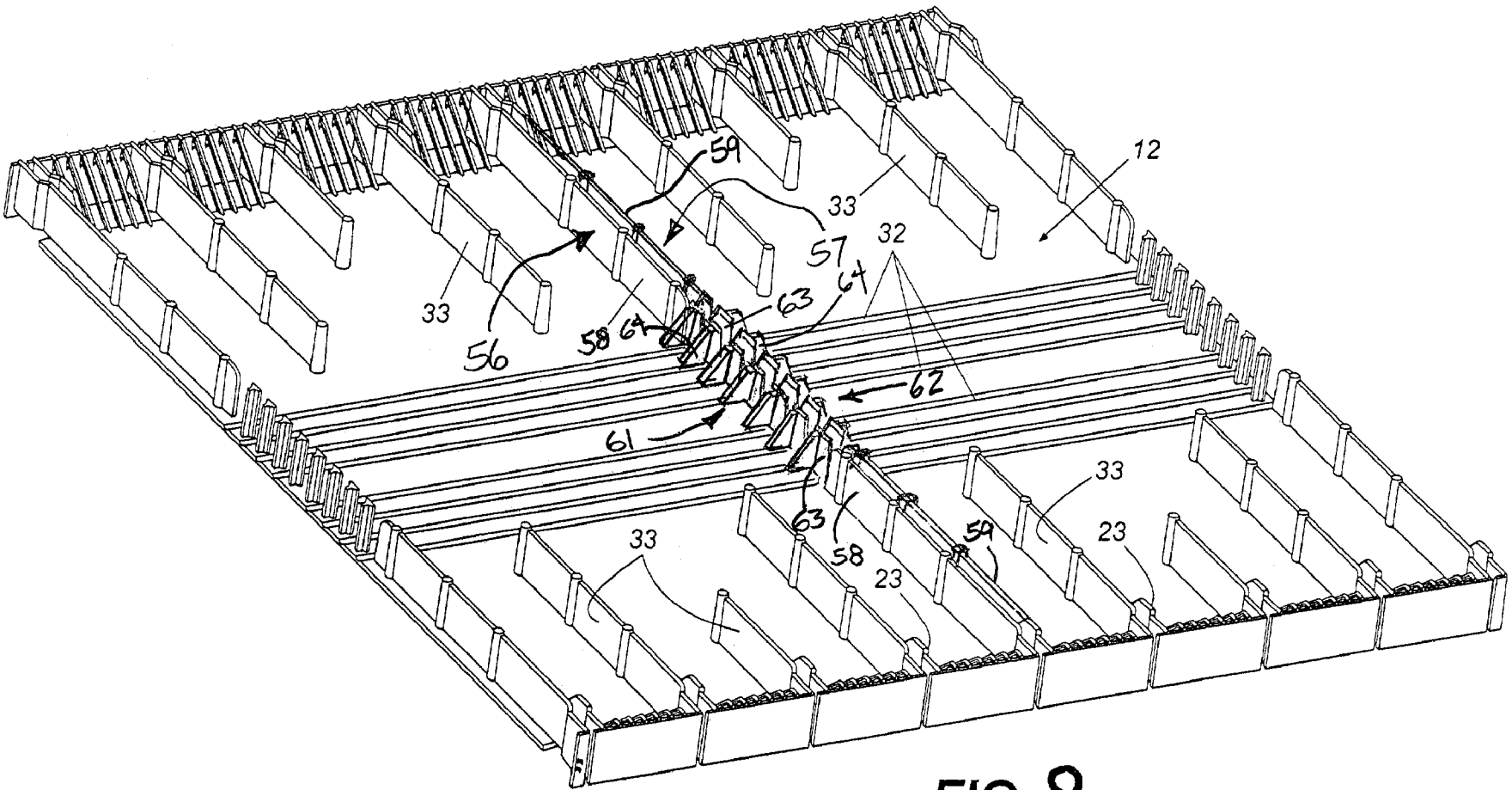
FIG. 9 is a perspective view of the underside of the ridge vent of FIG. 7 illustrating the closely spaced depending partitions that straddle a tear line and form end walls when the vent is torn along a tear line.

FIGS. 7–9 illustrate one embodiment of another unique aspect of this invention; namely, a ridge vent that is manually separable or tearable across its length without the need for measurement, tools, or separate end plug installation. This feature is described herein within the context of a ridge vent that resembles that of FIGS. 1–6. However, it should be understood that the manually separable feature of the invention is not limited to any particular type or shape of ridge vent. Indeed, this feature can be applied to enhance a rolled ridge vent such as that of FIGS. 1–6, a traditional panel-type ridge vent such as that illustrated in my prior incorporated patent, to a traditional fibrous mat type ridge vent, or to any other type of ridge vent. Beyond ridge vents, this unique feature also may be applied to other construction components such as, for example, elongated undereave vents or any construction component that must be cut, severed, or separated during installation. The invention should therefore be interpreted broadly to apply to any such construction component, even thought described herein in the context of a ridge vent.

FIG. 7 illustrates a section of a ridge vent that incorporates principles of the invention in a preferred form. Again, the illustrated section in the figures may be a portion of a longer panel-type ridge vent or a long roll of rolled ridge vent as discussed above. A relatively short section is illustrated in the figures for clarity of discusion. As with the embodiment of FIGS. 1–6, the ridge vent 11 has a top panel 12 with a central portion 13 and edges 14 and 16. Wind baffles 17 and 18 extend in a longitudinal direction outboard of the edges 14 and 16 respectively and are supported by buttresses 22 and 23. The particular configuration of ridge vent illustrated in FIG. 7 is a rollable ridge vent similar to that shown in FIGS. 1–6 and, accordingly, each of the wind baffles is formed by a series of aligned baffle sections 19 and 21 as discussed above. However, as mentioned above, the ridge vent may be a panel-type ridge vent, in which case the wind baffles generally may be continuous along the length of the vent. Alternatively, the ridge vent also may be a woven mat-type or any other type of ridge vent and the present aspect of the invention is equally applicable.

The ridge vent 11 is formed with at least one tear line extending transversely across the vent for manual separation of the ridge vent along the tear line. In general, the tear line is a line of relative weakness extending across the ridge vent and may take on any of a number of configurations. In FIG. 7, two possible types of tear line configurations are illustrated and are considered by the inventors to be alternative best modes of carrying out the invention. Specifically, tear line 46 is formed by a series of perforations 48 formed in the top panel 12 and the perforations 48 are aligned with each other across the width of the panel. Together, the aligned perforations, form a line of relative weakness along which the panel can be separated, as detailed below. As an alternative to aligned perforations, tear line 49 is an example of a tear line formed by a score 49 molded into the plastic of the ridge vent. The score 49 forms a line of relatively thinner plastic and thus defines the line of relative weakness along which the ridge vent may be separated.

In practice, transverse tear lines preferably are formed at spaced intervals of, for example, one foot along the length of the ridge vent. In a long rolled ridge vent, a large number of tear lines are formed at these spaced intervals all along the length of the ridge vent. In a panel-type ridge vent of, say, four or five feet in length, three or four tear lines may be formed at one foot intervals along the length of the vent. Of course, the tear lines may be spaced at intervals other than one foot if desired and the specific spacing suggested in the preferred embodiment is not a limitation of the invention. Preferably, however, the tear lines are positioned so that their ends are transversely aligned with a gap between two baffle sections outboard of the panel edges, as illustrated in FIG. 7.

FIG. 8 illustrates the manual tearing or separation of a ridge vent along a tear line according to the invention. In practice, the separation is accomplished by grasping one of the edges of the ridge vent in each hand with one hand on either side of a tear line. One section of the vent is then pulled back as indicated by arrows 53. As this section is pulled back, the ridge vent progressively tears or separates along the tear line, which, in FIG. 8, is the tear line 46 formed by aligned perforations 48.

When the vent is completely separated, two new free ends 51 are left along what was the tear line. A pair of depending partitions 52 (only one of which is visible in FIG. 8) molded on the bottom of the vent panel straddling the tear line (described in detail below) automatically form end plugs or end walls adjacent each of the newly formed ends. The end wall at the new end of the installed length of ridge vent prevents infestation and leakage through the end of the vent. The end wall at the new end of the separated length is ready for installation beginning at and end of another roof ridge. Therefore, an advantage of the present invention is that no scrap is created when the ridge vent is separated along a tear line.

FIG. 9 is a perspective view of the underside of a ridge vent that incorporates tear lines according to the invention. Here, slightly spaced apart depending partitions 56 and 57 are molded into the ridge vent and these partitions span, i.e. are located on either side of, a tear line. The partition 56 is formed with end portions 58, similar to the supports 33 discussed above, and a segmented central portion 61. The central portion 61 is defined by a series of aligned and spaced depending segments 63 each supported by a triangular brace 64. In a similar manner, the depending partition 57 has end portions 59 and a segmented central portion 62.

When the ridge vent is separated along the tear line extending between the two depending partitions 56 and 57, one of the depending partitions becomes the end wall at one of the newly formed ends and the other becomes the end wall at the other newly formed end. The segmented central portions 61 and 62 function in the same manner as the central portion 27 of a factory end wall (FIG. 1) to allow the ridge vent to be bent over a roof ridge along its center while forming a substantially impervious barrier against leakage and infestation at the newly formed end.

Figure 10:
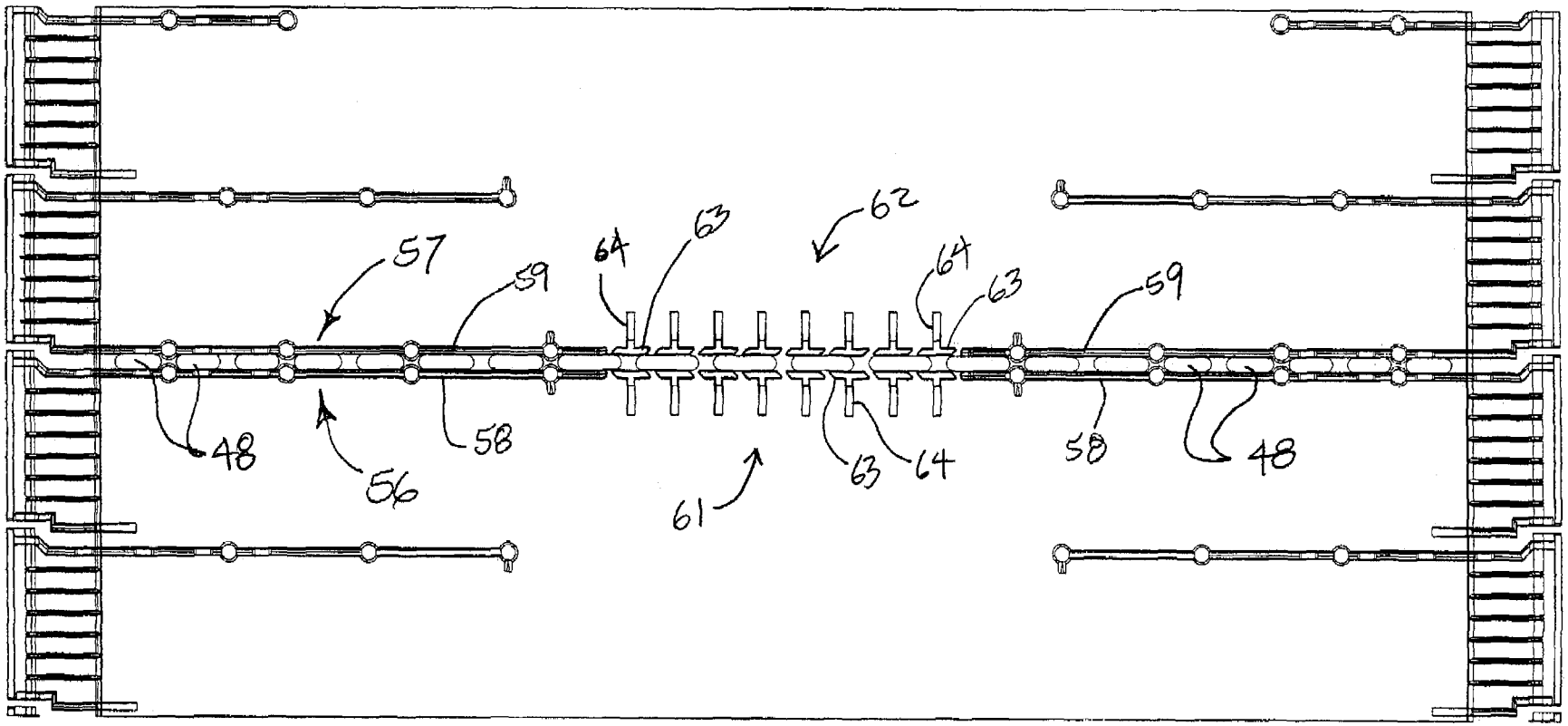
FIG. 10 is a bottom plan view of the vent section of FIG. 9 illustrating a preferred configuration of the depending partitions and their relationship to a corresponding tear line.

FIG. 10 is a bottom plan view of the short section of ridge vent illustrated in FIG. 9. Here, the tear line formed by-the series of aligned perforations 48 can be seen clearly extending across the ridge vent between the two depending partitions 56 and 57. Although the perforations of the illustrated embodiment are somewhat elongated with rounded ends, they might just as well take on other shapes such as, for example, round, oval, rectangular, or otherwise, all within the scope of the invention. The depending partitions 56 and 57 extend along either side of the tear line and each is composed of end portions and a segmented central portion as described above. With regard to the segmented central portions of the partitions, each segment of the central portion preferably is tapered and formed with angled side edges as shown. In this way, when one of the partitions forms an end wall at a newly separated end, the bending of the ridge vent over a roof ridge causes the angled edges of the segments to bunch or crowd together to form a reliably impervious barrier at the new end of the ridge vent.

Installation of a ridge vent incorporating the manually separable feature of this invention proceeds as follows. An installer installs the ridge vent along a roof ridge in the traditional way. If it is a rolled ridge vent, the vent is rolled out along the roof ridge and attached with appropriate fasteners. If it is a panel-type ridge vent, then individual panels are fastened with appropriate fasteners along the roof ridge in end-to-end relationship. In either case, when the end of the roof ridge is reached, there generally is excess ridge vent that must be removed from the installed portion of the vent. To remove the excess portion, the installer simply selects a tear line near where the vent needs to terminate. The vent is then grasped as described above and the excess portion is simply torn away. The resulting new end of the installed length of vent, which automatically incorporates an end wall, is secured to the roof deck with appropriate fasteners. All of this is accomplished quickly, accurately, and easily without the need to measure and mark the ridge vent, without requiring any knife or other tools whatsoever. Shingles can then be attached atop the ridge vent in the traditional manner to complete the installation. Since a depending end wall also is automatically formed at the newly created end of the torn away length of ridge vent, a new installation along another roof ridge, either on the same building or a different building, can be started at this free end. Thus, no scrap is created either at the installation or the next installation.

The invention has been described herein in terms of preferred embodiments that are considered by the inventors to be the best mode of carrying out the invention. The specifics of the illustrated embodiments are not, however, intended to be nor should they be considered to be limitations of the invention. Indeed, the spirit and scope of the invention is set forth only in the claims hereof. Many additions, deletions, and modifications might be made to the illustrated embodiments by skilled artisans without departing from that spirit and scope. For instance, as previously mentioned, the manually separable feature illustrated in FIGS. 7–10 is, applicable to virtually any type of ridge vent including rolled ridge vent, panel-type ridge vent, fiber mat ridge vent, or otherwise. The tear lines may be formed in any appropriate manner other than the perforations and score lines suggested in the preferred embodiments. Indeed, any feature that allows the ridge vent to be separated manually across its length is considered to be within the scope of the definition of "tear lines." Thus, the term "tear lines" as used herein and in the claims could be replaced with equivalent terms such as "tear zones," "tear features," "separation lines," "separation zones" or the like, and all are considered to be within the meaning of "tear lines." Finally, the manually separability of this invention also may be applied to numerous construction components other than just ridge vents. For example, undereave vents also may benefit from this feature as may other construction components that are installed in long lengths. Additional variations may be implemented by those of skill in the art all without departing from the spirit and scope of the invention set forth in the claims.

What is claimed is:

1. A ridge vent for installation along the ridge of a roof to provide attic ventilation, said ridge vent comprising an elongated body having a width sufficient to span the roof ridge and at least one tear line formed across the width of said elongated body, said tear line configured to allow selective manual separation of said elongated body at said tear line;

said ridge vent having a top panel normally spaced from a roof deck when said ridge vent is installed, and further comprising a first depending partition formed in said top panel extending along one side of said tear line, said first depending partition defining an end wall on an end that is formed when said elongated body is separated along said tear line; and a second depending partition formed on said top panel extending along the other side of said tear line, said second depending partition defining an end wall on the other end that is formed in said ridge vent when said elongated body is separated along said tear line.

2. A ridge vent as claimed in claim 1 and wherein said tear line is defined by a line of relative weakness formed across said elongated body.

3. A ridge vent as claimed in claim 2 and wherein said line of relative weakness is defined by aligned perforations.

4. A ridge vent as claimed in claim 2 and wherein said line of relative weakness is defined by a score line.

5. A ridge vent as claimed in claim 1 and wherein a plurality of tear lines are formed at spaced intervals along said elongated body.

6. A ridge vent as claimed in claim 1 and wherein each of said depending partitions has end portions and a central portion, said central portion being configured to allow said top panel be bent along its length for installation along a roof ridge.

7. A ridge vent as claimed in claim 6 and wherein each central portion is formed by a series of spaced depending segments that bunch together when said top panel is bent.

8. A ridge vent as claimed in claim 1 and further comprising wind baffles extending along and outboard of said top panel, said tear line being formed across said top panel.

9. A ridge vent as claimed in claim 8 and further comprising a separation line formed in each of said wind baffles aligned with respective ends of said tear line.

10. A ridge vent as claimed in claim 9 and wherein said separation lines comprise relatively narrow slits formed in said wind baffles.

11. A ridge vent as claimed in claim 10 and wherein said wind baffles are supported by buttresses extending outwardly from beneath said top panel, one of said buttresses being disposed on either side of said relatively narrow slits.

12. A ridge vent as claimed in claim 11 and wherein said buttresses on either side of said narrow slits extend across said top panel on either side of said tear line to form said depending partitions at the ends formed when said top panel is separated along said tear line.

13. A method of installing a ridge vent along the ridge of a roof, the ridge vent having tear lines formed across the width of and at spared intervals along the ridge vent and depending partitions extending along at least some of the tear lines on either side thereof, said method comprising the steps of progressively attaching the ridge vent along the roof ridge to form an installed portion and an excess portion of the ridge vent and manually separating the installed portion and the excess portion of said ridge vent along a selected one of said tear lines to form an end wall of the installed portion of said ridge vent on one side of said selected tear line and an end wall of the excess portion of the ridge vent on the other side of the tear line.

14. The method of claim 13 and wherein the ridge vent is a rolled ridge vent.

15. The method of claim 13 and wherein the ridge vent is a panel-type ridge vent.

* * * * *